United States Patent [19]

Dalbo et al.

[11] Patent Number: 4,664,302

[45] Date of Patent: May 12, 1987

[54] THREADED NEEDLE HOLDER FOR NEEDLE CRAFT PROJECTS

[76] Inventors: Lorraine E. Dalbo; Emil J. Dalbo, both of 1764 Timberland Rd., NE., Atlanta, Ga. 30345

[21] Appl. No.: 842,144

[22] Filed: Mar. 21, 1986

[51] Int. Cl.[4] ..... A41H 19/00; B65D 85/24

[52] U.S. Cl. ..... 223/109 R; 223/109 A; 223/106; 206/382; 206/388; 206/574

[58] Field of Search ..... 233/109 R, 106, 109 A; 206/388, 382, 350, 574

[56] References Cited

U.S. PATENT DOCUMENTS

| | | | |
|---|---|---|---|
| 361,248 | 4/1887 | Winton | 223/109 A |
| 2,646,196 | 7/1953 | York | 223/106 |
| 3,727,658 | 4/1973 | Eldridge, Jr. | 206/382 X |
| 3,949,452 | 4/1976 | Henderson | 206/388 X |
| 4,264,011 | 4/1981 | Dalbo et al. | 206/574 |
| 4,411,363 | 10/1983 | Walker | 206/388 |
| 4,494,653 | 1/1985 | Praderio | 206/388 X |
| 4,561,579 | 12/1985 | Brown | 223/109 R |

*Primary Examiner*—Henry S. Jaudon
*Assistant Examiner*—J. L. Olds
*Attorney, Agent, or Firm*—James B. Middleton

[57] ABSTRACT

A threaded needle holder for needle craft projects is disclosed. The needle holder is made up of a rectangular card with a magnet parallel to one long edge of the card. A plurality of slits spaced along the long edge act to receive thread carried by needles received on the magnet. The needle will extend across the magnet to a line on the opposite side, the line receiving the number or the like for the color thread in the needle. The name of the project being worked on can also be placed on the card. Optionally, magnets can be fixed to the rear of the card to allow the needle holder to be mounted on a magnet board.

7 Claims, 5 Drawing Figures

THREADED NEEDLE HOLDER FOR NEEDLE CRAFT PROJECTS

INFORMATION DISCLOSURE STATEMENT

When a person is engaged in needle crafts such as cross-stitch, embroidery and the like, one must generally use a large number of different colors of thread. While a single needle can be threaded and unthreaded in order to change colors, it is common for people engaged in such an activity to have a plurality of needles, each needle having a different color of thread for use on a given project.

Given the large number of needles, with a different color of thread in each needle, the problem arises in the handling of this large group of needles. It should be realized that different colors of thread are frequently only slightly different shades of the same color so the difference is not readily discernible. Even if one can readily detect the difference between the two threads, in the creation of a picture it is important to select the proper shade for the proper portion of the picture. The proper organization of the needles with the appropriate thread is therefore very important.

It is known in the art to utilize a magnet or the like as a place to hold a needle. It is also common to use pincushions, and of course various people have their own methods or systems to keep track of the needles and the thread colors. Still, there is no easy system for maintaining the needles separate from one another and readily identifying the thread attached to the needle, especially if the plurality of needles must be stored temporarily for later work on the project.

SUMMARY OF THE INVENTION

This invention relates generally to needlecraft accessories, and is more particularly concerned with a threaded needle holder for maintaining the needles separate and identifying the thread therein.

The present invention comprises a needle card having needle holding means thereon. Adjacent to the needle holding means is thread holding means for receiving thread associated with a given needle. Indicating means are also provided in association with the needle holding means so the particular thread can be identified, as by number, and the needle, indicating means and thread remain associated with one another. Preferably, there is also a project indicating means for ready identification of the project with which the particular group of colors is associated.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
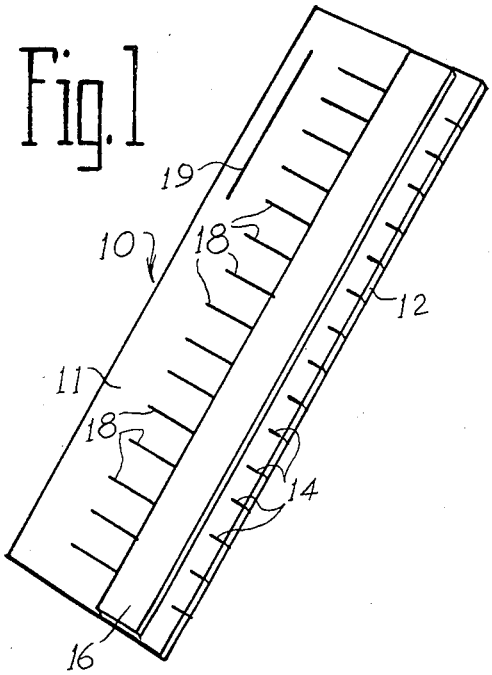
FIG. 1 is a perspective view of one form of threaded needle holder made in accordance with the present invention.

Referring now more particularly to the drawings, and to that embodiment of the invention here presented by way of illustration, it will be seen in FIG. 1 that the threaded needle holder generally designated at 10 includes a needle card 11 which is generally rectangular in configuration. The right hand edge 12 as here illustrated includes a plurality of slits 14 that extend generally perpendicularly to the edge 12 and terminate a short distance into the card 11.

Adjacent to the edge 12, there is a strip 16 that is a magnetic material. Those skilled in the art will understand that numerous forms of magnets are readily obtainable in strips such as the strip 16, and the strip, or magnet 16, can easily be glued or otherwise affixed to the card 11.

Each of the slits 14 is in association with a line 18 on the opposite side of the magnet 16, the lines 18 constituting the thread color indicating means for the present invention. It will also be noted that, in the upper left hand corner as shown in FIG. 1, there is a line 19 on which the name of the particular project can be entered.

Figure 2:
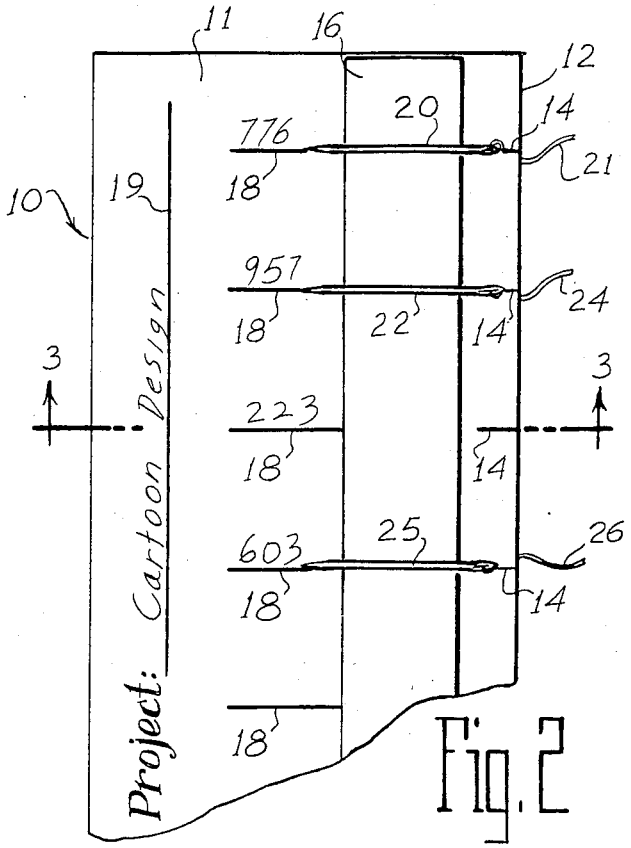
FIG. 2 is an enlarged, fragmentary plan view showing one end of the threaded needle holder illustrated in FIG. 1.

Attention is next directed to FIG. 2 of the drawings which shows one end of the threaded needle holder 10 in more detail. Since the needle holder 10 is uniform throughout its length, it will be understood that the portion shown in FIG. 2 is illustrative of the entire needle holder.

In FIG. 2, there is a plurality of needles shown on the needle holder 16. The needle 20 is threaded with thread 21. The needle 20 is of steel or the like so that it is readily attracted to and held by the strip, or magnet, 16. The thread 21 on the needle 20 has a color designated by the number 776, so the number 776 is entered on the line 18 adjacent to the needle 20. Similarly, there is a needle 22 having thread 24 threaded therein, the thread 24 having a color indicated by the number 957; and, a needle 25 has thread 26, the color of the thread 26 being indicated by the number 603.

As is seen in FIG. 2, the needles 20, 22 and 25 can be placed on the needle holder 16, and the thread 21, 24 and 26 can be kept neatly at one side of the needles. The appropriate number on the line 18 will readily identify the color of thread without the necessity for carefully comparing colors to be sure the appropriate color and shade have been selected.

Obviously, since the needles 20, 22 and 25 are simply laid on the magnet 16, there is some chance that the needles could move, or be inadvertently brushed into the wrong location. If this were to happen, the labeling would be of no value since one would not know which needle was associated with which indicating means. With this in mind, the slits 14 are aligned with the lines 18; and, when a needle, such as a needle 20, is placed on the needle holder 16, the thread 21 is urged into the slit 14. Since the needle card 11 will be formed of sheet material, the slit 14 will be simply a slit, with no material actually removed, so the slit 14 will tightly hold the thread 21. Nevertheless, the thread 21 can be easily jerked into the slit 14 when the needle 20 is to be temporarily stored; and, one can simply lift the needle 20 and pull the thread 21 from the slit 14. The arrangement therefore provides for needle holding means, indicating means for the color of thread in the needle, and thread holding means for assuring that the proper needle is adjacent to the proper indicating means.

Figure 4:
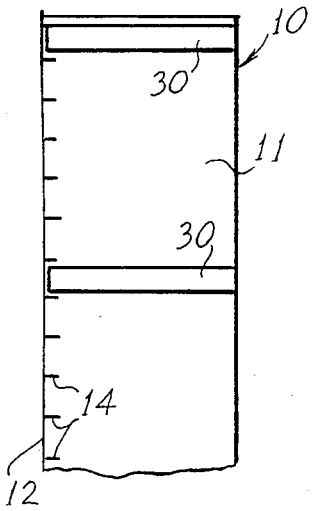
FIG. 4 is a partial rear plan view showing the device illustrated in FIG. 1; and, FIG. 5 is a perspective view showing one arrangement for use of the threaded needle holder of the present invention.
Figure 3:
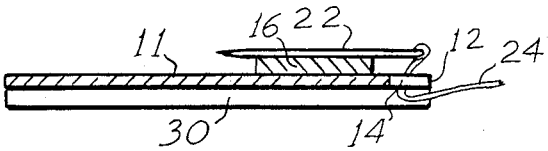
FIG. 3 is a cross-sectional view taken substantially along the line 3—3 in FIG. 2.

Looking now at FIGS. 3 and 4 of the drawings, it will be seen that the card 11 is provided with mounting means 30. While various people will use the threaded needle holder 10 in different ways, some form of mounting means may be frequently desirable so the needle holding means can be placed in one location for easy access. A mounting means appropriate to the desired location will render the device more convenient. As is shown in FIGS. 3 and 4, there is a plurality of strip magnets 30 disposed transversely of the needle card 11. It will be seen that the magnets 30 are spaced between the slits 14 to prevent interference of the magnets, or mounting means, 30 with the use of the slits 14.

Figure 5:
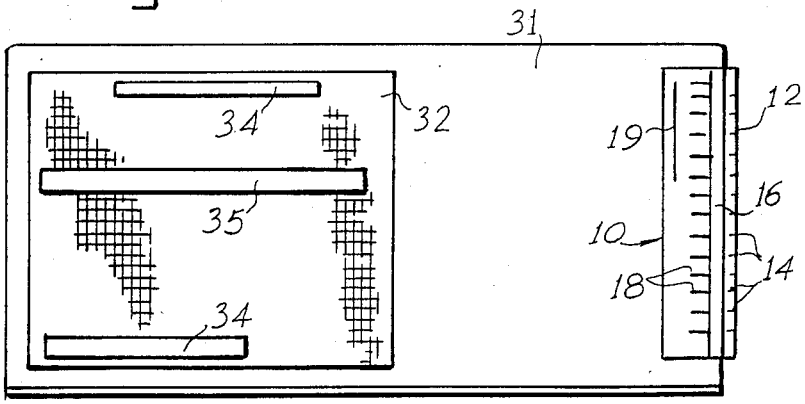

To illustrate a possible use of the mounting means 30, attention is directed to FIG. 5 of the drawings. A person doing, for example, cross-stitch may utilize a board 31 that is ferromagnetic material. The graph 32 being worked on will be held to the board 31 by magnets 34, and another magnet 35 may be used to show the line being worked on. Since the person will have this material readily available, the threaded needle holder 10 of the present invention can conveniently mount at one edge of the board 31. As here shown, the threaded needle holder 10 is on the right hand edge of the board 31 with the slits 14 hanging over the edge of the board 31 sufficiently that the thread on the needles can easily pass through the slits 14. Thus, a needle such as the needle 20 can be placed on the strip 16, and the needle 20 can be held while the thread 21 is slightly jerked to urge it into the slit 14. The needle 20 will then stay in the appropriate location until it is ready for reuse. When the needle is to be used, the needle 20 can be lifted, and a slight jerk will remove the thread 21 from the slit 14.

When the arrangement provided by the present invention, it will be understood that the threaded needle holder 10 may be of sufficient size to allow each color in one project to be threaded into one of a plurality of needles, the numbers can be placed on the lines 18, and a needle can be placed adjacent to the appropriate lines. When the person must temporarily cease work on the project, all of the needles can be placed on the needle holder 16 and the thread urged into the adjacent slit 14. Long lengths of thread can be wrapped around the needle card 11, and the entire apparatus can be stored in a small carrying case or the like. When the project is to be resumed, each needle will be adjacent to the appropriately numbered line since the thread will remain in the slit 14. Even if needles are somewhat askew from their intended position, the attached thread will be held, and the needles can be quickly straightened out and the project resumed.

While the needle holder 16 is here disclosed as a magnetic strip, it will be obvious that a piece of fabric or the like to receive a needle therethrough could be substituted and the same results obtained. Also, the threaded needle holder may be used without any particular mounting means, or other forms of mounting means could be utilized with equal success.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. A needle holder for use in holding a plurality of needles being used in a single needlecraft project, each needle having a different thread therein, said needle holder including a needle card, needle holding means carried by said needle card for receiving said plurality of needles, and a plurality of thread holding means for receiving threads carried by said plurality of needles, a plurality of thread indicating means on said needle card, each thread indicating means of said plurality of thread indicating means being substantially aligned with one of said thread holding means, said needle card having a first edge, said needle holding means being adjacent to said first edge, said thread holding means comprising a plurality of slits defined in said first edge, said needle holder being so constructed and arranged that a needle can be received by said needle holding means and thread carried by said needle can be received by one of said slits constituting said thread holding means, said needle holder comprising an elongate strip generally parallel to said first edge of said needle card for receiving a plurality of needles therealong.

2. A needle holder as claimed in claim 1, said thread indicating means comprising lines on said needle card for selective entry of identifying indicia.

3. A needle holder as claimed in claim 2, and wherein said elongate strip constituting said needle holder is a magnet.

4. A needle holder as claimed in claim 3, and further including project indicating means on said needle card, said project indicating means including a line for receiving a title for the needlecraft project.

5. A needle holder as claimed in claim 4, and further including mounting means for supporting said needle card, said mounting means being carried on the back of said needle card.

6. A needle holder as claimed in claim 5, said mounting means comprising magnets for attaching said needle card to ferromagnetic material.

7. A needle holder as claimed in claim 6, said needle card being generally rectangular, said first edge being one long side of the rectangular card, said elongate strip being between said thread indicating means and said thread holding means so that a needle held by said needle holding means can extend over said thread indicating means and over said thread holding means.

* * * * *